US006893408B2

(12) United States Patent
Wang

(10) Patent No.: US 6,893,408 B2
(45) Date of Patent: May 17, 2005

(54) PALM-SIZE MULTI-FUNCTIONAL MASSAGE DEVICE

(76) Inventor: Wan-Chuan Wang, 5F, No. 7-3, Kung-Kuan Rd., Peitou, Taipei (TW)

( * ) Notice: Subject to any disclaimer, the term of this patent is extended or adjusted under 35 U.S.C. 154(b) by 25 days.

(21) Appl. No.: 10/652,344

(22) Filed: Aug. 29, 2003

(65) Prior Publication Data

US 2005/0049534 A1 Mar. 3, 2005

(51) Int. Cl.[7] ..... A61H 19/00
(52) U.S. Cl. ..... 601/135; 601/137
(58) Field of Search ..... 601/135, 136, 601/137

(56) References Cited

U.S. PATENT DOCUMENTS 4,461,285 A * 7/1984 Courtin ..... 601/137
4,590,926 A * 5/1986 Courtin ..... 601/137
5,382,222 A * 1/1995 Yih-Jong ..... 601/135
5,577,997 A * 11/1996 Thariani et al. ..... 601/135

* cited by examiner

*Primary Examiner*—Michael A. Brown
(74) *Attorney, Agent, or Firm*—W. Wayne Liauh

(57) ABSTRACT

An integrally molded palm-size multi-functional massage device has a thicker rear end and a thinner front end. A central portion of the rear end has an upper and a lower projection to define between them a largest height of the massage device. The massage device has an upper and a lower surface respectively extending from the rear upper and lower central projections toward the front end and two lateral sides of the massage device, so that the front end and the two lateral sides are reduced in thickness. A recess is formed on the upper surface, and an area outside the recess is slightly upward curved and has multiple rib strips provided thereon. While the upper surface provides a frictional massaging effect, projections formed on outer edges of the massage device serve as pressing points adapted to create different magnitudes of pressure against a user's body.

5 Claims, 2 Drawing Sheets

PALM-SIZE MULTI-FUNCTIONAL MASSAGE DEVICE

FIELD OF THE INVENTION

The present invention relates to a palm-size multi-functional massage device that does not require a power supply and may be held with one hand to massage body areas at different depths under skin with different magnitudes of pressure.

BACKGROUND OF THE INVENTION

Most people living in the modern society lack body exercises. With the body always maintained in the same posture over a long time, a person tends to have aching back and waist, and stiffened neck. The development and popularization of computer also causes people to operate over the keyboard for a prolonged time and suffer from overly tired fingers and sore arms.

The stiffened and ached muscles and joints have close relation with the blood circulation in our body. A body area having poor blood circulation tends to become stiffened and ached. On the other hand, muscles at some body areas that do not move for a prolonged time would inevitably have poor blood circulation. One of many ways for improving the blood circulation is to massage device to achieve massaging effect not only through pressing and tapping but also frictionally contacting body areas, so that massaging of different body areas at different depths under skin, including areas surrounding joints and knuckles, in different manners may be performed with only one single massage device.

The palm-size multi-functional massage device of the present invention is an integrally molded and non-powered massage device. The massage device has a thicker rear end and a thinner front end. A central portion of the rear end has an upper and a lower projection to define a largest height of the massage device. The massage device has an upper surface extending from the rear upper central projection toward the front end and two lateral sides thereof. A recess is formed on the upper surface, and an area outside the recess is slightly upward curved and has multiple rib strips provided thereon. The upper surface provides a frictional massaging effect, and is suitable for massaging the backs of hands, the insteps, the forearms, and the joints and knuckles.

The recess provided on the upper surface of the massage device prevents the massage device from directly impacting on the joints and knuckles, while a peripheral wall of the recess provides an enhanced massaging effect. Moreover, when the upper surface of the massage device is used to pat or tap some body areas, the recess serves as a hollow space in an arched palm.

The upper surface of the massage device of the present invention has a rear edge that has a raised central portion and two outward declined lateral sides, and is therefore suitable for moving along body areas to produce the massaging effect.

The massage device includes a lower surface having the rear lower central projection formed thereon to provide the most projected pressing point on the massage device. Two lines separately between the rear lower central projection and two lateral ends of the massage device are two slightly concaved curves suitable for rubbing or scraping different body areas.

More than one projection is provided along outer edges of the massage device to serve as pressing points adapted to create different magnitudes of pressure against different body areas.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
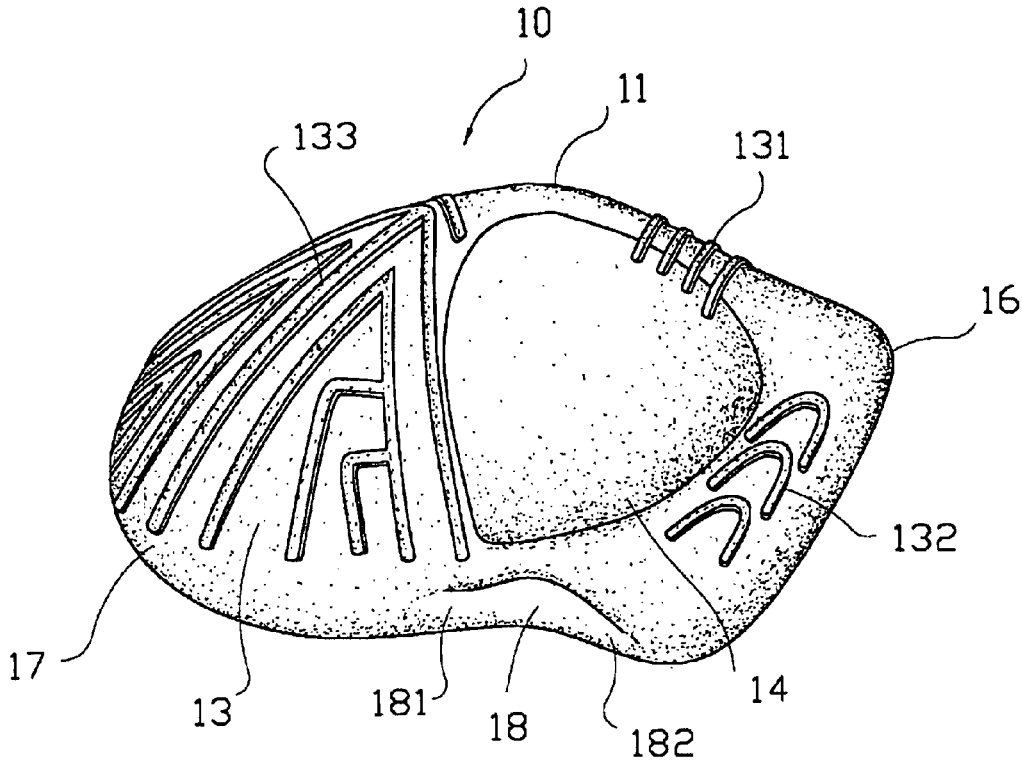
FIG. 1 is a front top perspective view of a palm-size multi-functional massage device according to the present invention.
Figure 2:
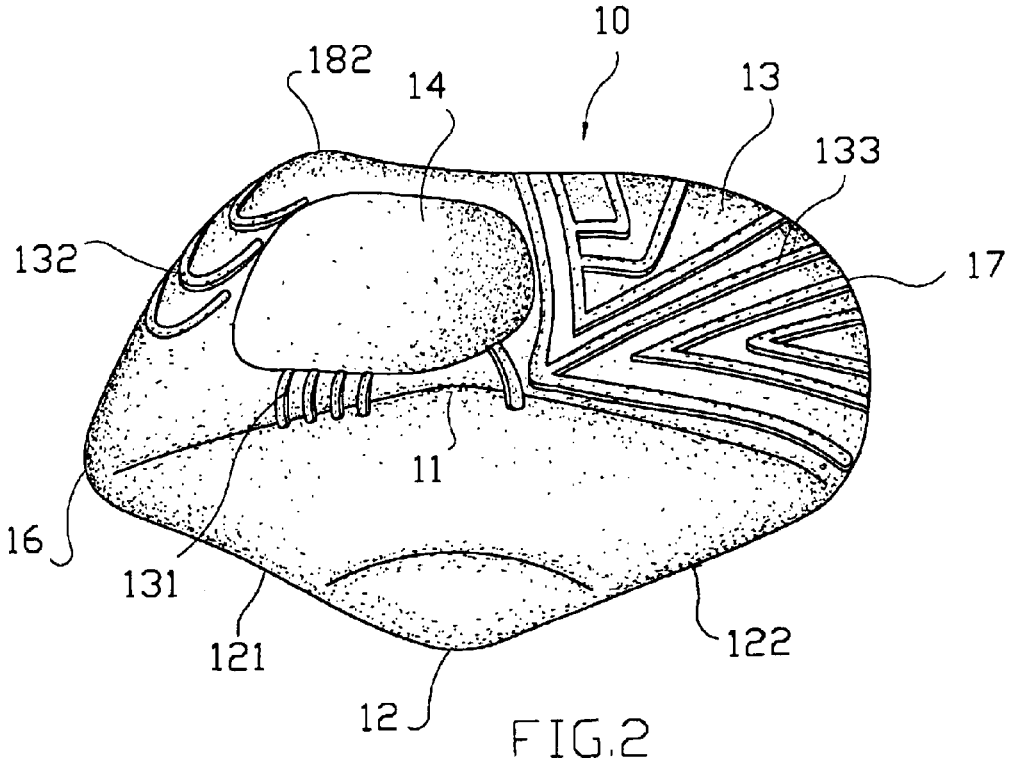
FIG. 2 is a rear top perspective view of the palm-size multi-functional massage device of FIG. 1.
Figure 5:
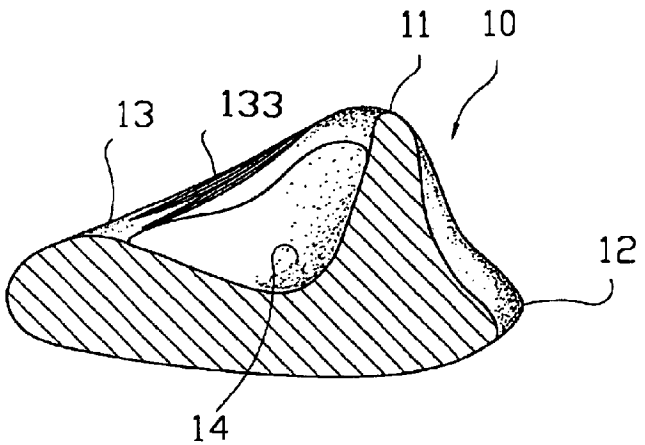
FIG. 5 is a sectional view of the palm-size multi-functional massage device of FIG. 1.
Figure 3:
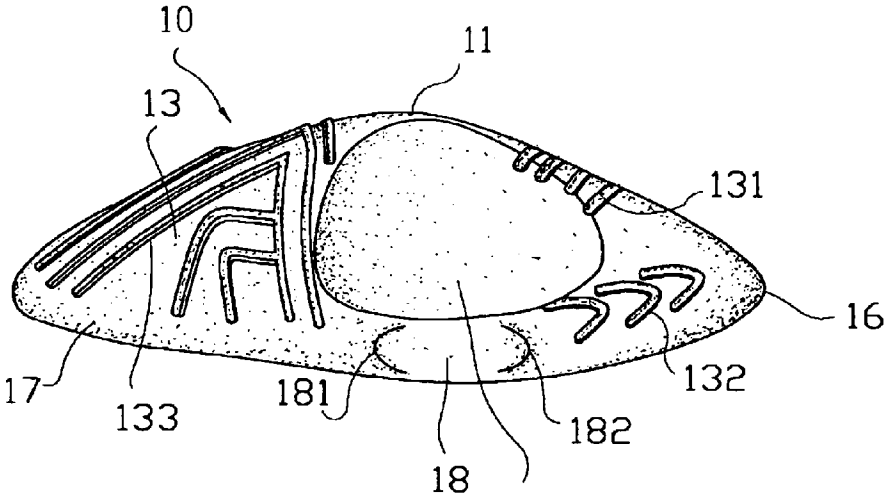
FIG. 3 is a front view of the palm-size multi-functional massage device of FIG. 1.
Figure 4:
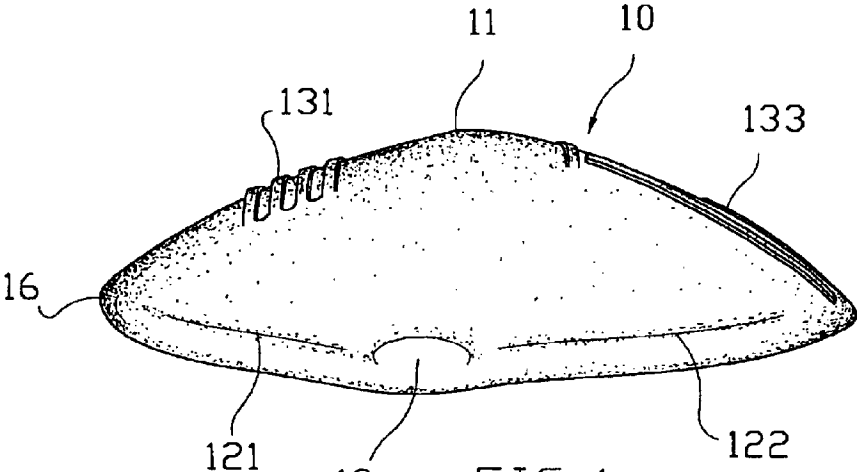
FIG. 4 is a rear view of the palm-size multi-functional massage device of FIG. 1.

Please refer to FIGS. 1 to 4, in which a palm-size multi-functional massage device 10 according to the present invention is shown. As shown, the massage device 10 has an integrally molded body having a thicker rear end and a thinner front end. A central portion of the rear end has an upper and a lower projection 11, 12 to define between them a largest height of the massage device 10. An upper surface 13 of the massage device 10 starts from an upper edge of the rear end to gradually decline from the rear upper central projection 11 toward the front end and two lateral sides of the massage device 10, and a recess 14 is formed on the upper surface 13, as shown in FIG. 5. An area of the upper surface 13 other than the recess 14 has a slightly upward curved contour. Differently shaped rib strips 131, 132, 133 are provided on predetermined locations on the upward curved area of the upper surface 13. A lower surface 15 of the massage device 10 gradually upward extends from the rear lower central projection 12 toward the front end and the two lateral sides of the massage device 10, so that the front end and the two lateral sides of the massage device 10 are reduced in thickness, as can be clearly seen from FIGS. 3 and 4.

The upper surface 13 of the massage device 10 provides a friction-type massaging surface mainly for frictionally massaging a user's backs of the hands, insteps, arms, joints and knuckles, and different areas on the skin. The recess 14 on the upper surface 13 of the massage device 10 enables close contact of the massage device 10 with a joint or knuckle without impacting and hurting the latter, and a peripheral wall of the recess 14 is adapted to provide an enhanced effect of the friction-type massage. When patting or tapping the user's body with the upper surface 13 of the massage device 10, the recess 14 provides a hollow space so that the massage device 10 functions just like a slightly arched palm.

Another projection 16 is formed at a rightmost end of the massage device 10 to serve as a pressing point. A left part of the front end of the massage device 10 is a curved edge 17. By movably pressing the curved edge 17 of the massage device 10 against an area on the user's body, it is possible to produce a smooth pressing effect on a linear position within the area being massaged. A dent 18 is provided near a center of the front end of the massage device 10 for the user to rest one finger thereat and therefore easily hold the massage device 10. Two further projections 181, 182 are therefore formed at two lateral sides of the dent 18 to serve as two further pressing points producing different magnitudes of pressure, too.

That is, the rear upper central projection 11, the rear lower central projection 12, the right projection 16, and the two projections 181, 182 at two lateral sides of the dent 18 all are pressing points on the massage device 10 to produce different magnitudes of pressure against the user's body. The user may select one of these pressing points best suitable for massaging a certain selected body area, or depending on personal preference.

The massage device 10 may be integrally molded with a resin material. Moreover, material radiating infrared rays may be added into the resin material to enhance the massage effect. The user may use the massage device 10 in different manners to massage different body areas, such as moderately pressing, rubbing, or moving the massage device 10 against the areas to be massaged. Alternatively, it is possible to take advantage of the weight of the massage device 10 to moderately tap the user's body areas to achieve the effect of massaging. Therefore, the massage device 10 is multi-functional and may be used in multiple manners as desired.

The rear lower central projection 12 on the lower surface 15 of the massage device 10 may be the most projected one among all the pressing points. Edges between the rear lower central projection 12 and two lateral ends of the massage device 10 are two slightly concaved curves 121, 122 having different curvatures.

The user may use the concaved edges 121, 122 to scrape or rub against selected body areas. That is, the massage device 10 may be used as a scraper to scrape or rub some specific areas on the body to relieve some discomfort, pain, or ache according to Chinese folk medicine.

A rear edge of the front surface 13 of the massage device 10 has a projected central portion. When the massage device 10 is used to linearly massage a selected area on the user's body by pressing the rear edge of the front surface 13 from left to right side against the selected body area, a beginning, a middle, and an ending point at the rear edge tend to produce massaging effect on different depths under the user's skin.

In brief, the palm-size multi-functional massage device 10 of the present invention has particularly designed configuration and contours to enable massaging different body areas at different depths under skin using different manners and different magnitudes of pressure. For example, the massage device 10 may be used to rub, scrape, press, tap, and pat different body areas to achieve the effect of massage. When using the massage device 10, a user may have various choices to obtain the most desirable and comfortable massaging effect.

What is claimed is:

1. A palm-size multi-functional massage device, comprising an integrally molded body having a thicker rear end and a thinner front end; a central portion of said rear end having an upper and a lower projection to define between them a largest height of said molded body; said molded body having an upper surface starting from an upper edge of said rear end to gradually decline from said rear upper central projection toward said front end and two lateral sides of said molded body, a recess being formed on said upper surface, and an area of said upper surface other than said recess having a slightly upward curved contour, and differently shaped rib strips being provided on predetermined locations on said upward curved area of said upper surface; and said molded body also having a lower surface gradually upward extended from said rear lower central projection toward said front end and two lateral sides of said molded body, so that said front end and said two lateral sides of said molded body are reduced in thickness.

2. The palm-size multi-functional massage device as claimed in claim 1, wherein said molded body is formed at a rightmost end with a rightward projection to serve as a pressing point.

3. The palm-size multi-functional massage device as claimed in claim 2, wherein said molded body is formed at a left part of said front end with a curved edge.

4. The palm-size multi-functional massage device as claimed in claim 2, wherein said molded body is formed near a center of said front end with a dent, so that two lateral sides of said dent are formed into two projections having different curvatures.

5. The palm-size multi-functional massage device as claimed in claim 2, wherein two edges of said molded body separately located between said rear lower central projection and two lateral ends of said molded body are two slightly concaved curves having different curvatures.

* * * * *